US009174273B2

(12) United States Patent
Sekiguchi et al.

(10) Patent No.: US 9,174,273 B2
(45) Date of Patent: Nov. 3, 2015

(54) METHOD OF AND APPARATUS FOR CONTROLLING MOLTEN METAL SURFACE IN MOLD OF CONTINUOUS-CASTING MACHINE AND CONTINUOUS-CASTING MACHINE INCLUDING THE APPARATUS

(71) Applicant: JP STEEL PLANTECH CO., Yokohama (JP)

(72) Inventors: Takeshi Sekiguchi, Yokohama (JP); Shigeo Nakamura, Yokoyama (JP)

(73) Assignee: JP STEEL PLANTECH CO., Kanagawa (JP)

( * ) Notice: Subject to any disclaimer, the term of this patent is extended or adjusted under 35 U.S.C. 154(b) by 0 days.

(21) Appl. No.: 14/256,582

(22) PCT Filed: Oct. 11, 2012

(86) PCT No.: PCT/JP2012/076316

§ 371 (c)(1),
(2) Date: Apr. 18, 2014

(87) PCT Pub. No.: WO2013/058161

PCT Pub. Date: Apr. 25, 2013

(65) Prior Publication Data

US 2015/0000859 A1 Jan. 1, 2015

(30) Foreign Application Priority Data

Oct. 21, 2011 (JP) ..... 2011-231428

(51) Int. Cl.

| | |
|---|---|
| ***B22D 11/16*** | (2006.01) |
| ***B22D 11/051*** | (2006.01) |
| ***B22D 11/18*** | (2006.01) |

(52) U.S. Cl.
CPC ..... *B22D 11/181* (2013.01); *B22D 11/051* (2013.01); *B22D 11/166* (2013.01)

(58) Field of Classification Search
CPC ... B22D 11/051; B22D 11/166; B22D 11/181
USPC ..... 164/4.1, 452, 449.1, 478, 416
See application file for complete search history.

(56) References Cited

U.S. PATENT DOCUMENTS 3,519,060 A * 7/1970 Vischulis ..... 164/450.5

FOREIGN PATENT DOCUMENTS

| | | |
|---|---|---|
| JP | 2000-322106 | 11/2000 |
| JP | 2005-238239 | 9/2005 |

* cited by examiner

*Primary Examiner* — Kevin P Kerns
*Assistant Examiner* — Steven Ha
(74) *Attorney, Agent, or Firm* — Muramatsu & Associates

(57) ABSTRACT

A method of and an apparatus for controlling a molten metal surface in a mold that are effective to various disturbances are provided. The method and the apparatus for controlling a molten metal surface level in a mold according to the present invention perform the following operations of: measuring the molten metal surface level in the mold of a continuous-casting machine; changing a reference position of oscillation of the mold based on the difference between a molten metal surface setting value set in advance as a desired value of the molten metal surface and a measured value of the molten metal surface level; and making the reference position of oscillation follow molten metal surface fluctuations.

4 Claims, 5 Drawing Sheets

METHOD OF AND APPARATUS FOR CONTROLLING MOLTEN METAL SURFACE IN MOLD OF CONTINUOUS-CASTING MACHINE AND CONTINUOUS-CASTING MACHINE INCLUDING THE APPARATUS

This application is a U.S. national stage entry of International Patent Application No. PCT/JP2012/076316, filed Oct. 11, 2012, claiming the benefit of foreign filing priority under 35 U.S.C. 119(e) based on Japanese Patent Application No. 2011-231428, filed Oct. 21, 2011, 2008, the entire contents of which are incorporated herein by reference.

TECHNICAL FIELD

The present invention relates to a method of and an apparatus for controlling a molten metal surface in a mold of a continuous-casting machine, and a continuous-casting machine including the apparatus.

BACKGROUND ART

When the height (i.e. level) of a molten metal surface in a casting mold (mold) greatly fluctuates, impurities such as powder on the molten steel surface will be included into the steel that is in contact with the mold and being solidified. When the impurities are included into the steel, defects and/or cracks occur on the surface of the steel piece and are exposed in the form of a flaw or a scab on the steel plate at the time of rolling, having a significant influence on quality and yield. For this reason, it is required to suppress the fluctuations of the molten metal surface in the mold.

As an example of such a method of controlling the molten metal surface level in a mold, there has been disclosed in Patent Document 1, "a method of controlling a molten metal surface level in a mold of a continuous-casting machine", for example.

The "method of controlling a molten metal surface level in a mold of a continuous-casting machine" disclosed in Patent Document 1 is "a method of controlling the molten metal surface level by measuring a molten metal surface level in a mold of a continuous-casting machine, inputting the difference between the measured value and a setting value into a feedback controller, operating an actuator based on the control output from the feedback controller, controlling, with the use of the driving power output from actuator, the amount of opening of a sliding nozzle that is provided for a tundish and used to supply molten steel, characterized by including: an estimation and calculation step of estimating periodic disturbance that causes molten metal surface level fluctuations based on the difference of the measured value of the molten metal surface level from the setting value and calculating the manipulated variable of adaptive control for cancelling the molten metal surface level fluctuations caused by the estimated periodic disturbance; and an operation step of operating the actuator, in which the calculated, manipulated variable of adaptive control is added to the control output from the feedback controller as a feed-forward value for changing the amount of opening of the sliding nozzle" (see claim 1 of Patent Document 1).

PRIOR ART DOCUMENT

Patent Document

Patent Document 1: JP 2000-322106 A

SUMMARY OF INVENTION

Problem to be Solved by the Invention

Control of the molten metal surface in a mold that has already been proposed is such that the amount of opening of a sliding nozzle provided for a tundish is controlled to control the amount of molten metal to be supplied to the mold so that the molten metal surface level is maintained at a constant level.

The control performed by controlling the amount of opening of the sliding nozzle is basically PID control. There have been various proposals regarding the control method, exemplified by the above Patent Document 1, to enhance the response to disturbance and certain results have been achieved.

However, there are various disturbances, such as molten metal surface waves, bulging-type molten metal surface fluctuations, molten metal surface fluctuations caused by, for example, clogging of the sliding nozzle due to the object adhered to the sliding nozzle.

The molten metal surface waves mean a state, in which while the average level of the molten metal surface does not fluctuate, the height of the molten metal surface varies depending on the position. There are the molten metal surface waves that are caused by oscillation of the mold (frequency: 2 to 3 Hz) and the molten metal surface waves that are standing waves excited by movement of an immersed nozzle (frequency: 0.6 to 0.9 Hz).

The bulging-type molten metal surface fluctuations and the molten metal surface fluctuations caused by, for example, clogging of the sliding nozzle due to the object adhered to the sliding nozzle are such that the average level of the molten metal surface fluctuates and therefore, these fluctuations are different from the molten metal surface waves in this respect.

The bulging-type molten metal surface fluctuations are such that the entire molten metal surface moves up and down when bulging occurs periodically that is a phenomenon, in which the thin part of steel that has been solidified bulges outward at a portion not supported by rolls. The frequency of the bulging-type molten metal surface fluctuations is 0.05 to 0.15 Hz.

The molten metal surface fluctuations caused by, for example, clogging of the sliding nozzle due to the object adhered to the sliding nozzle include a case where the molten metal surface level is lowered by the reduction in the amount of molten steel supplied to the mold caused by the clogging of the sliding nozzle due to the object adhered to the sliding nozzle, for example, and a case where the molten metal surface level is rapidly raised by the rapid increase in the amount of supply of the molten steel when the adhered object is removed from the sliding nozzle for some reason.

The control to maintain the molten metal surface level at a constant level by controlling the amount of opening of the sliding nozzle is effective in the case of the above bulging-type molten metal surface fluctuations such that the average level of the molten metal surface fluctuates and in the case of the molten metal surface fluctuations caused by, for example, clogging of the sliding nozzle due to the object adhered to the sliding nozzle.

However, the disturbances such that the average level of the molten metal surface fluctuates include one that is periodic, one that is nonperiodic, and one, of which the period varies. Accordingly, it is impossible to remove such disturbances by merely controlling the amount of opening of the sliding nozzle even when various control theories are applied and therefore, an ultimate solution to maintaining the molten metal surface in the mold at a constant level has not been achieved yet.

The present invention has been made to solve such a problem and an object of the present invention is to provide a method of and an apparatus for controlling a molten metal surface in a mold, which are effective to various disturbances, and a continuous-casting machine including the apparatus.

Means for Solving the Problem

As described above, it is impossible to remove disturbances by merely controlling the amount of opening of the sliding nozzle even when various control theories are applied. This is because the response of the sliding nozzle to the control of the amount of opening thereof is slow and therefore, various disturbances cannot be dealt with.

Under such circumstances, the inventor of this application focused on the fact that the speed of response of the mold oscillation control is equal to or higher than 1 Hz, which is overwhelmingly higher than the speed'of response of the sliding nozzle and based on this fact, the inventor reached a new method of using the mold oscillation control to control the molten metal surface in a mold. Specifically, the inventor has found that, by making the reference position of oscillation (center of oscillation) of the mold follow the fluctuating level of the molten metal surface to maintain the contact interface between the molten steel and the mold (that is, initial solidification position) at a constant level, it becomes possible to cancel the disturbances that could not be dealt with by merely controlling the amount of opening of the sliding nozzle.

In other words, the way of thinking is changed from the conventional focus on maintaining the molten metal surface level (height from a fixed point on the Earth) at a constant level to a method of maintaining "the relative level between the mold and the molten metal surface" at a constant level.

The present invention has been made on the basis of such a new idea and specifically, the present invention includes the following modes.

(1) A method of controlling a molten metal surface level in a mold according to the present invention is characterized by including: measuring the molten metal surface level in the mold of a continuous-casting machine; changing a reference position of oscillation of the mold based on a difference between a molten metal surface setting value set in advance as a desired value of the molten metal surface and a measured value of the molten metal surface level; and making the reference position of oscillation follow molten metal surface fluctuations.

Note that, in this description, controlling a molten metal surface level in a mold means controlling the position of the mold and/or the molten metal surface level (height from a fixed point on the Earth) to control the relative level between the mold and the molten metal surface.

(2) The present invention is further characterized in that, in the method according to the above item (1), the molten metal surface level is controlled by controlling the amount of opening of a sliding nozzle based on the difference between the measured value and the setting value.

(3) An apparatus for controlling a molten metal surface level in a mold according to the present invention is characterized by including: a mold oscillation controller for controlling oscillation of the mold of a continuous-casting machine; and a molten metal surface level meter for measuring the molten metal surface level in the mold, wherein the mold oscillation controller is configured to receive a measured value from the molten metal surface level meter and control a reference position of oscillation of the mold based on the received value.

(4) The present invention is further characterized in that the apparatus according to the above item (3) further includes a sliding-nozzle opening amount-controlling device that is configured to receive the measured value from the molten metal surface level meter to control the amount of opening of a sliding nozzle.

(5) A continuous-casting machine according to the present invention is characterized by including the apparatus for controlling the molten metal surface level in the mold according to the above item (3) or (4).

Effects of Invention

In the method of controlling a molten metal surface level in a mold according to the present invention, the molten metal surface level in a mold of a continuous-casting machine is measured and the reference position of oscillation of the mold is changed based on the difference between the measured value and the molten metal surface setting value that has been set as a desired value of the molten metal surface in advance, so that the reference position of oscillation follows the molten metal surface fluctuations. As a result, it is made possible to maintain the contact interface between the molten steel and the mold (in other words, initial solidification position), which brings about effects similar to those obtained when the fluctuations of the absolute level of the molten metal surface are prevented, that is, inclusions of impurities, such as powder, on the molten steel surface due to the fluctuations of the molten metal surface are prevented and therefore, the occurrence of defects and/or cracks on the surface of the steel piece is prevented.

DESCRIPTION OF REFERENCE NUMERALS

Figure 1:
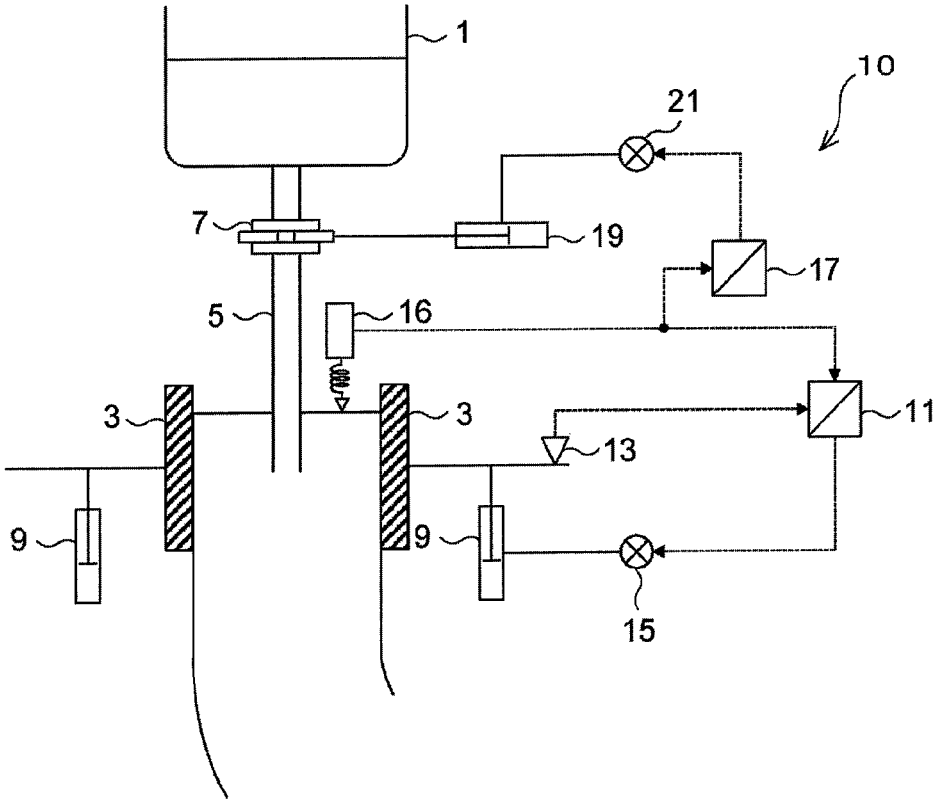
FIG. 1 shows a diagram for explaining an apparatus for controlling a molten metal surface level in a mold according to an embodiment of the present invention.

1 tundish
3 mold
5 immersed nozzle
7 sliding nozzle
9 mold position-controlling cylinder
10 mold molten-metal surface level-controlling apparatus
11 mold oscillation controller
13 mold position level meter

15 first servo valve
16 molten metal surface level meter
17 molten metal surface level controller
19 sliding-nozzle hydraulic cylinder
21 second servo valve
23 molten steel
25 powder layer
27 half-melted layer
29 molten layer
31 slag rim
33 powder adhesion layer
35 powder flow layer
37 solidified shell

EMBODIMENT FOR CARRYING OUT THE INVENTION

Before explaining a method of and an apparatus for controlling a molten metal surface level in a mold according to an embodiment, main components of a continuous-casting machine related to the method and the apparatus will be described with reference to FIG. 1.

In FIG. 1, reference numeral 1 indicates a tundish, reference numeral 3 indicates a mold, reference numeral 5 indicates an immersed nozzle for pouring molten metal in the tundish 1 into the mold 3, reference numeral 7 indicates a sliding nozzle for regulating the amount of molten metal to be supplied to the immersed nozzle 5, the sliding nozzle 7 being provided between the immersed nozzle 5 and the tundish 1.

The sliding nozzle 7 is provided with a sliding-nozzle hydraulic cylinder 19 for opening and closing the sliding nozzle 7. A molten metal surface level controller 17 controls a second servo valve 21 based on a measured value from a molten metal surface level meter 16, whereby the amount of opening of the sliding-nozzle hydraulic cylinder 19 is controlled.

Next, an apparatus for controlling a molten metal surface level in a mold according to the embodiment of the present invention will be described with reference to FIG. 1.

The mold molten-metal surface level-controlling apparatus 10 according to the present invention is characterized in that the apparatus 10 includes a mold oscillation controller 11 for controlling oscillation of the mold 3 of the continuous-casting machine and the molten metal surface level meter 16 for measuring the molten metal surface level in the mold 3, and in that the measured value from the molten metal surface level meter 16 is input to the mold oscillation controller 11 to control the reference position of oscillation of the mold 3 based on the input value.

A configuration of the mold oscillation controller, which is a feature of the embodiment, will be described in detail below.

The mold oscillation controller 11 is a device for controlling oscillation of the mold 3 of the continuous-casting machine. The mold oscillation controller 11 controls a first servo valve 15 for driving a mold position-controlling cylinder 9, thereby performing high-speed, continuous position control of the mold position-controlling cylinder 9.

The actual position of the mold 3 that is required for the mold oscillation controller 11 to perform the above control is acquired by a mold position level meter 13 and fed back to the mold oscillation controller 11.

A reference waveform signal for oscillation with a predetermined amplitude and a predetermined period with the reference position centered, and a difference between the measured value from the molten metal surface level meter 16 and a molten metal surface setting value (desired value) are input to the mold oscillation controller 11, which generates a composite control signal, in which the reference position is corrected based on the difference.

Figure 2:
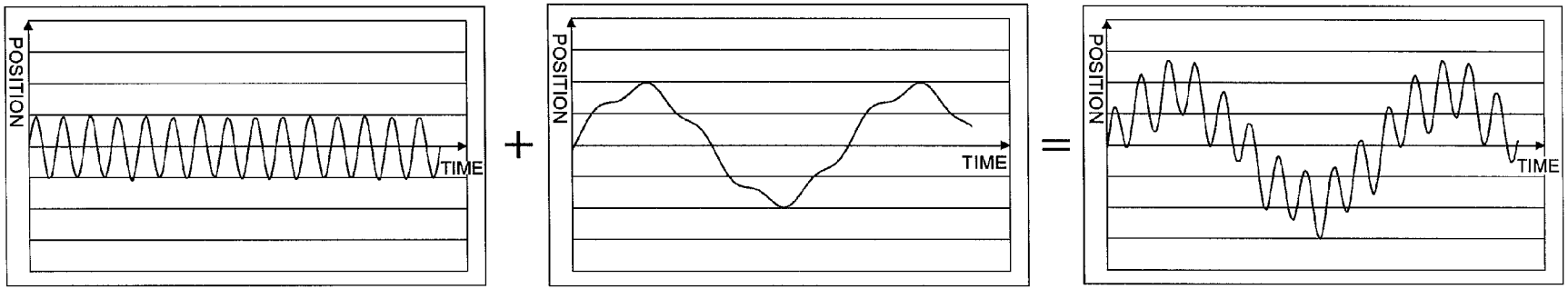
FIG. 2 shows graphs showing mold position control signals that are output from a mold oscillation controller of the apparatus, described in FIG. 1, for controlling the molten metal surface level in the mold.

FIG. 2 shows an example of signals associated with the present invention for controlling the molten metal surface. In the graphs in FIG. 2, the abscissa indicates time and the ordinate indicates position. FIG. 2(*a*) shows a base waveform signal of oscillation of the mold 3; FIG. 2(*b*) shows a difference between the measured value from the molten metal surface level meter 16 and the setting value (desired value) of the molten metal surface, that is, a reference position correction signal for correcting the oscillation reference position of the mold 3; and FIG. 2(*c*) shows the composite control signal, in which the base waveform signal and the reference position correction signal are combined, and which is output to the first servo valve 15 as a mold position control signal.

The mold oscillation controller 11 controls the first servo valve 15 based on the mold position control signal. In this way, while the mold 3 is oscillated, the position of the mold 3 is controlled so that the oscillation reference (center) position of the mold 3 is changed so as to follow the molten metal surface fluctuations.

In order for the mold oscillation controller 11 to generate a composite control signal, it suffices that a value resulting from the correction using the difference between the measured value of the molten metal surface and the molten metal surface setting value is used as a set variable (hereinafter referred to as "SV value") of the composite control signal. The relation is shown by the following Equation (1):

$$Y=f(fo,t)+\Delta H \tag{1}$$

where

Y: SV value
f(a,b): function of a and b
fo: frequency of oscillation of mold (Hz)
t: time
ΔH: difference between measured value and setting value of molten metal surface.

To make the mold 3 follow the molten metal surface fluctuations means to prevent the relative position between the meniscus and the mold 3 from varying from the viewpoint of the mold reference frame. Preventing the relative position between the meniscus and the mold 3 from varying results in preventing the initial solidification position relative to the mold from varying. Preventing the initial solidification position relative to the mold from varying has a significance in view of keeping the initial solidification portion stable to perform stable feeding of powder. This will be described in detail below with reference to FIG. 3 and FIG. 4.

Figure 3:
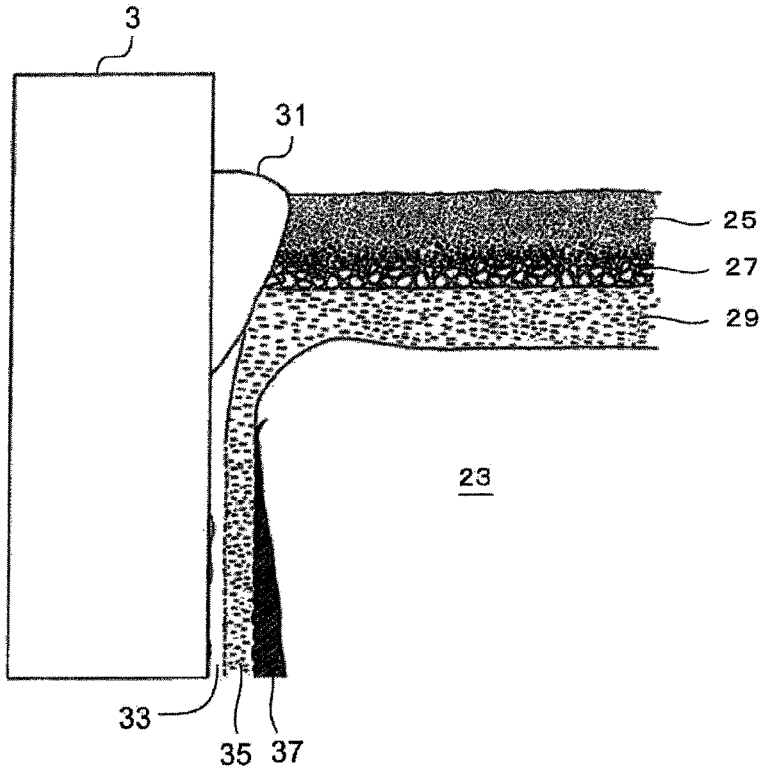
FIG. 3 shows an explanatory diagram for explaining a state of a surface of molten steel near a meniscus in the mold (taken from "Iron and Steel Handbook", 4th Edition).

As shown in FIG. 3, the powder is present in the forms of a powder layer 25, a half-melted layer 27, and a molten layer 29 on a molten steel 23. As shown in FIG. 3, the initial solidification portion forms a complicated state, including a slag rim 31, a powder adhesion layer 33, a powder flow layer 35, and a solidified shell 37, etc. When this state is stably maintained, it is possible to stably supply the powder in the molten layer 29 to the interface between the molten metal and the mold 3. When fluctuations of the molten metal surface occur, however, such a stable state (relative positional relationship) is broken, which can lead to the shortage or excess in the amount of powder fed and/or the inclusions of slag into the molten metal. Moreover, the temperature of the mold, with which the molten metal is in contact, rapidly varies and the conditions of solidification also significantly vary.

Figure 4:
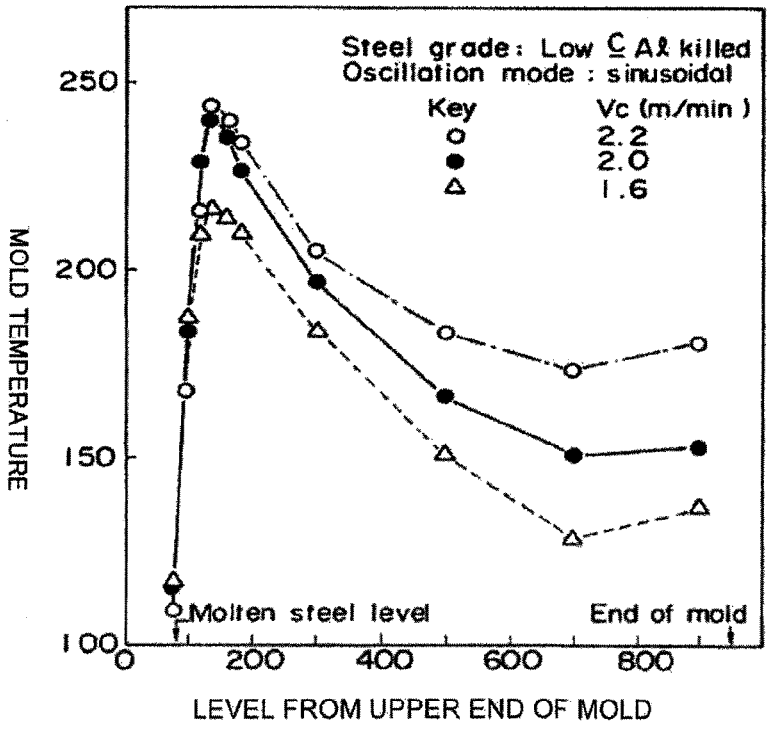
FIG. 4 shows a diagram showing distribution of temperature along height direction of the mold (taken from "Iron and Steel Handbook", 4th Edition).

Actually, as shown in FIG. 4, the distribution of temperature in the mold 3 rapidly varies in the vicinity of the molten metal surface even in stable conditions. If the initial solidification position deviates beyond the normal oscillation range, the temperature of the mold 3, with which the molten metal is in contact, rapidly varies and the conditions of solidification also significantly vary, so that it becomes impossible to maintain the stable initial solidification state. In other words, preventing the relative position between the mold 3 and the molten metal surface from varying makes it possible to maintain the stable initial solidification state. Specifically, by causing the reference position of oscillation of the mold 3 to follow the molten metal surface fluctuations to prevent the initial solidification position from varying, it becomes possible to maintain the stable initial solidification state and it also becomes possible to stably supply the powder to the interface between the molten steel and the mold 3.

As described above, making the reference position of the mold 3 follow the molten metal surface fluctuations has significant effects of maintaining the stable initial solidification and of making it possible to stably supply powder. From the viewpoint of the mold reference frame, however, making the mold follow the molten metal surface fluctuations means that only the speed of drawing the cast piece varies (according to the rate of change of the mold position), which raises concerns for the influence of this control on the speed of drawing the cast piece. For this reason, the influence of the change of the reference position of the mold on the speed of drawing the cast piece will be discussed below.

The oscillation caused by the oscillating action also causes the change of speed of drawing the cast piece from the viewpoint of the mold reference frame. For this reason, as a way of discussing the influence of the change of the reference position of the mold on the speed of drawing the cast piece, comparison is made with the oscillatory motion speed.

First, the speed of oscillatory motion caused by oscillation is determined. The oscillation is assumed to be sinusoidal. The speed of sinusoidal oscillatory motion is determined by the Equation (2). In this equation, V is speed of oscillatory motion, r is amplitude, and f is frequency.

$$V=r\times 2\pi\times f \tag{2}$$

The speed of oscillatory motion caused by oscillation can be determined as shown by the Equation (3).

$$Vo=ro\times 2\pi\times fo=100\text{ mm/s}=6\text{ mpm} \tag{3}$$

In this equation,

Vo: speed of oscillatory motion caused by oscillation ro: amplitude of oscillation fo: frequency of oscillation, where fo=4 (Hz) and ro=4 (mm).

This means that the relative drawing speed varies by the above speed Vo=6 mpm from the viewpoint of the oscillating mold reference frame.

Next, as an example of the molten metal surface fluctuations, bulging-type molten metal surface fluctuations are taken and the speed of oscillatory motion to make the mold reference frame position follow the molten metal surface fluctuations was determined.

In this case, the speed of oscillatory motion of the mold reference position is equal to the speed of the bulging-type molten metal surface fluctuations. For this reason, the speed of molten metal surface fluctuations due to bulging is obtained from the Equation (4) based on the Equation (2).

$$Vb=rb\times 2\pi\times fb=3.1\text{ mm/s}=0.19\text{ mpm} \tag{4}$$

In this equation, it is assumed that

Vb: speed of molten metal surface fluctuations due to bulging rb: amplitude of molten metal surface fluctuations due to bulging fb: frequency of bulging where fb=0.1 (Hz) and rb=5 (mm).

It can be seen from the Equations (3) and (4) that the speed of oscillatory motion caused by oscillation is incomparably higher than that of the bulging-type molten metal surface fluctuations. For this reason, the influence that is exerted on the casting speed when the mold is caused to follow the bulging-type molten metal surface fluctuations is less than the influence of oscillation on the casting speed, that is, almost negligible.

Figure 5:
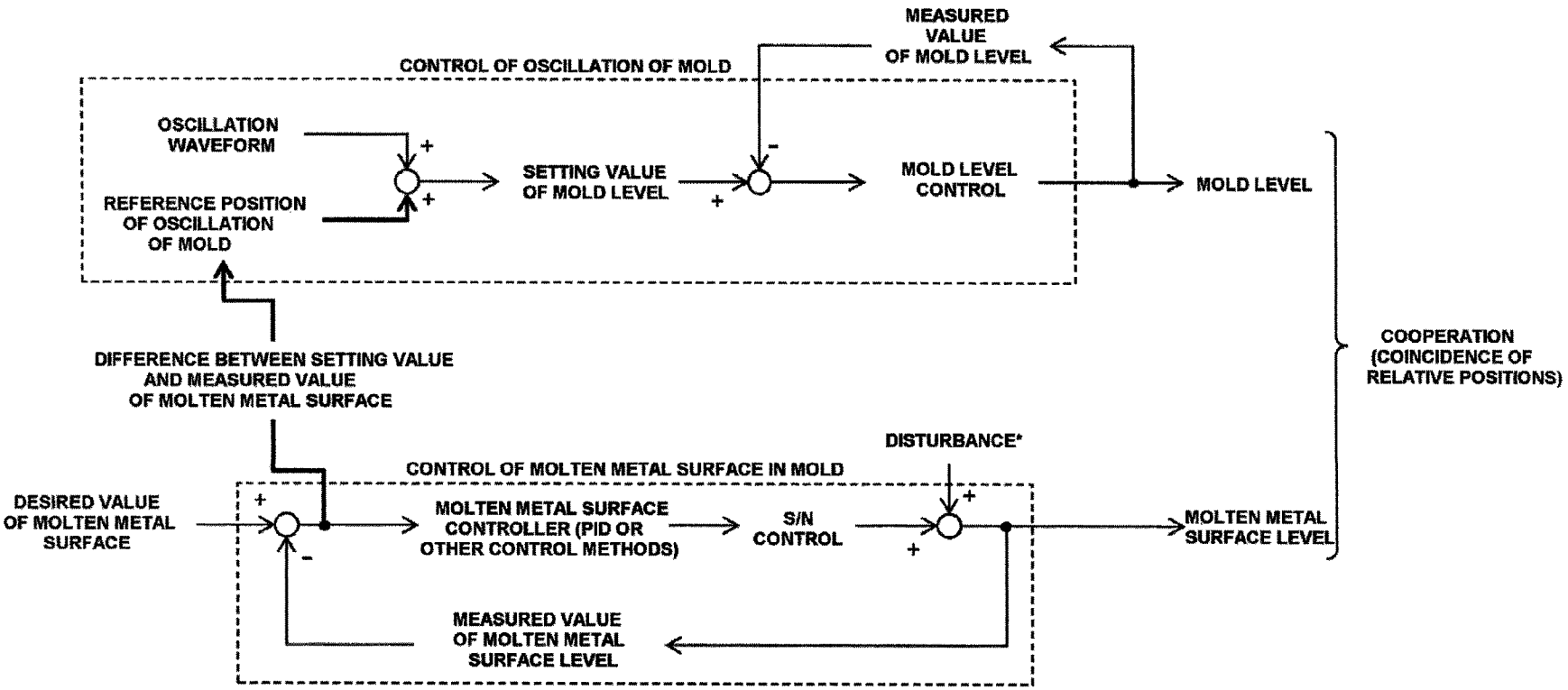
FIG. 5 shows a diagram for explaining a method of controlling the apparatus, described in FIG. 1, for controlling the molten metal surface level in the mold.

Next, a flow of control performed in the continuous-casting machine of the present embodiment configured as described above will be described with reference to FIG. 5. FIG. 5 is an illustration of the flow of control, using arrows.

The method of controlling the molten metal surface level in the mold performed in the continuous-casting machine of the present embodiment is mainly divided into two control operations, mold oscillation control and sliding nozzle control.

In the mold oscillation control, the molten metal surface level in the mold 3 of the continuous-casting machine is measured and the reference position of oscillation of the mold 3 is changed based on the difference of the measured value from the setting value, whereby the reference position of oscillation is caused to follow the molten metal surface fluctuations. This will be specifically described below.

A base oscillation waveform for the oscillating action, which has its center at the reference position of oscillation, is set in advance in the mold oscillation controller 11 (see FIG. 2(*a*)). In order to make the mold 3 follow the molten metal surface fluctuations, the reference position of oscillation is corrected based on the difference of the measured value of the molten metal surface acquired from the molten metal surface level meter 16 from the molten metal surface setting value (see FIG. 2(*b*)). The oscillation waveforms are synthesized with the corrected reference position of oscillation centered, making an instruction value of the mold position (SV value) (see FIG. 2(*c*)).

Next, the actual mold position (PV value) measured by the mold position level meter 13 is compared with the SV value and correction corresponding to the difference is performed with use of the first servo valve 15 to operate the mold position-controlling cylinder 9 so that the mold position is brought to a predetermined position, whereby constant oscillation with respect to the molten metal surface is maintained.

Next, the flow of the sliding nozzle control will be described. The sliding nozzle control means control of the molten metal surface level by controlling the amount of opening of the sliding nozzle 7 based on the difference between the setting value of the molten metal surface and the measured value of the molten metal surface from the molten metal surface level meter 16. This will be specifically described below.

The setting value (SV value) of the molten metal surface is provided in advance to the molten metal surface level controller 17. The difference is calculated based on the setting value of the molten metal surface and the actual molten metal surface level (PV value) measured by the molten metal surface level meter 16. The molten metal surface level controller 17 controls the second servo valve 21 based on the difference and thus the amount of opening of the sliding nozzle 7 is controlled by the second servo valve 21. The amount of molten metal poured into the mold 3 is controlled by controlling the amount of opening of the sliding nozzle 7, whereby the molten metal surface level is continuously controlled.

As described above, the mold 3 in this embodiment is oscillated while following the molten metal surface level and the molten metal surface level is controlled with use of the sliding nozzle 7, whereby both control operations cooperate with each other, thereby matching the mold position and the molten metal surface level relative to each other.

In this way, the relative position between the meniscus and the mold 3 remains the same, which makes it possible to maintain the initial solidification position in the mold 3. As a result, the stable initial solidification state is maintained, which brings about the effect that the shortage or excess in the amount of powder fed and/or the inclusions of slag into the molten metal are prevented to realize stable supply of the powder.

For the purpose of realizing the apparatus for controlling the molten metal surface in a mold according to the present embodiment, it suffices that the SV value setting logic in an existing mold oscillation controller is changed. This means that it is possible to use the existing mold oscillation controller, the existing actuator(s) for oscillating the mold 3, the existing molten metal surface level meter 16, etc. This also brings about the effect of reducing costs of the apparatus.

In the above description of the embodiment, the mold position-controlling cylinder 9 hydraulically operated has been described as an example of the device for oscillation. However, the oscillation device, to which the present invention can be applied, is not limited to the above one. Instead of the devices using the hydraulic cylinder using hydraulic pressure as described above, devices using an electrically-driven cylinder, or a lever-type oscillator, for example, may be used as long as the device can perform oscillation.

Note that the targets of the molten metal surface level control according to the embodiment include the above bulging-type molten metal surface fluctuations, in which the average level of the molten metal surface fluctuates, and the molten metal surface fluctuations caused by clogging, for example, of the sliding nozzle due to the object adhered to the sliding nozzle.

There is therefore a possibility that the molten metal surface waves such that the height of the molten metal surface varies depending on the position can remain as the disturbance signal that may have an adverse influence in terms of control in performing the control of the present embodiment.

This disturbance signal may be removed by providing the molten metal surface level meter 16 with a high-frequency filter to remove the oscillation with a frequency of, for example, equal to or higher than about 1 Hz.

This high-frequency filter may be provided at any part instead of at the molten metal surface level meter 16 as long as the high-frequency filter is installed so as to be able to remove the disturbance signal. Specifically, the high-frequency filter may be provided in the mold oscillation controller 11 or may be separately installed so as to remove the disturbance signal after the mold position control signal is output to the first servo valve 15.

A dumper may be provided to directly suppress the molten metal surface fluctuations physically.

EXAMPLE

Figure 6:
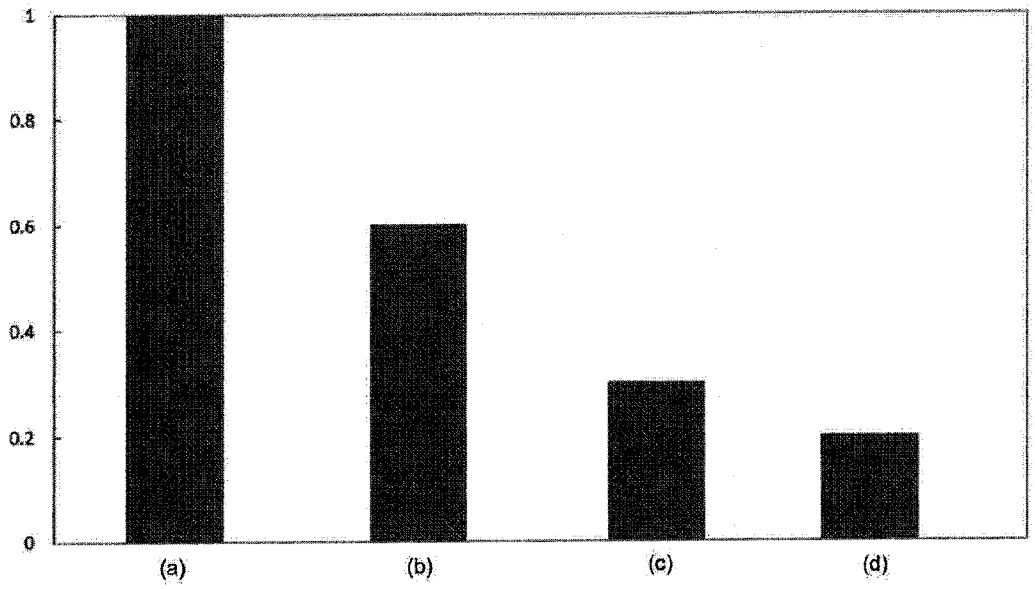
FIG. 6 shows a graph showing results of examples, by which effects of the present invention have been verified.

Control of a molten metal surface in a mold of a continuous-casting machine, to which the present invention was applied, was conducted and the result thereof is shown in FIG. 6. In the graph in FIG. 6, the abscissa indicates methods of controlling the molten metal surface and the ordinate indicates defect index.

FIG. 6(*a*) and FIG. 6(*b*) show the cases where control of the molten metal surface was performed using conventional methods only. FIG. 6(*a*) shows the case where control of the molten metal surface was performed using PID molten metal surface control only. FIG. 6(*b*) shows the case where control of the molten metal surface was performed using $H^{\infty}$ molten metal surface control only.

FIG. 6(*c*) shows the case where control of the molten metal surface was performed using both PID molten metal surface control and mold oscillation control according to the present invention. FIG. 6(*d*) shows the case where control of the molten metal surface was performed using both $H^{\infty}$ molten metal surface control and mold oscillation control according to the present invention.

The defect indices in the cases of FIG. 6(*a*) to FIG. 6(*d*) are expressed relative to that in FIG. 6(*a*).

From the results of comparison between the cases of FIG. 6(*a*) and FIG. 6(*c*) and between the cases of FIG. 6(*b*) and FIG. 6(*d*), it can be seen that, by applying the present invention, the defects are reduced to or below half of those of the conventional cases, in which control using similar methods is performed.

As described above, it has been found that the present invention can be applied to either of the control method using the PID molten metal surface control and the control method using the $H^{\infty}$ molten metal surface control, and that the present invention has a significant effect in preventing the occurrence of defects.

The invention claimed is:

1. A method of controlling a molten metal surface level in a mold of a continuous-casting machine, the method comprising:

performing oscillation of the mold by using at least one of a hydraulic cylinder and an electrically-driven cylinder; and controlling the oscillation of the mold by:

measuring a molten metal surface level in the mold;

generating a composite control signal by correcting a reference waveform signal of a predetermined amplitude and a predetermined period for the oscillation of the mold, based on a difference between a measured value of the molten metal surface level and a desired value of the molten metal surface level; and changing a reference position of the oscillation of the mold by operating at least one of the hydraulic cylinder and the electrically-driven cylinder according to the composite control signal to prevent a relative position between the mold and the molten metal surface level from varying to maintain an initial solidification state.

2. The method of controlling the molten metal surface level in the mold according to claim 1, wherein the molten metal surface level is controlled by controlling an amount of opening of a sliding nozzle based on the difference between the measured value of the molten metal surface level and the desired value of the molten metal surface level.

3. The method of controlling the molten metal surface level in the mold according to claim 1, wherein the changing of the reference position of the oscillation of the mold is performed so as to make the reference position of the oscillation follow molten metal surface fluctuations.

4. The method of controlling the molten metal surface level in the mold according to claim 1, further comprising:

measuring a mold position, wherein the changing of the reference position of the oscillation of the mold is performed based on a measured value of the mold position.

* * * * *